US007576714B2

(12) United States Patent
Kawaguchi et al.

(10) Patent No.: US 7,576,714 B2
(45) Date of Patent: Aug. 18, 2009

(54) DISPLAY-PANEL DRIVING METHOD

(75) Inventors: Hirofumi Kawaguchi, Tokyo (JP); Hirofumi Honda, Tokyo (JP); Tetsuro Nagakubo, Tokyo (JP)

(73) Assignee: Pioneer Corporation, Tokyo (JP)

( * ) Notice: Subject to any disclaimer, the term of this patent is extended or adjusted under 35 U.S.C. 154(b) by 479 days.

(21) Appl. No.: 11/099,702

(22) Filed: Apr. 6, 2005

(65) Prior Publication Data

US 2005/0259043 A1 Nov. 24, 2005

(30) Foreign Application Priority Data

Apr. 6, 2004 (JP) ..... 2004-111848

(51) Int. Cl.
*G09G 3/28* (2006.01)

(52) U.S. Cl. ..... 345/63; 315/169.1

(58) Field of Classification Search ..... 345/60–72; 315/169.1, 169.4
See application file for complete search history.

(56) References Cited

U.S. PATENT DOCUMENTS 6,331,843 B1 * 12/2001 Kasahara et al. ..... 345/63
6,476,781 B1 11/2002 Suzuki et al.
2002/0012075 A1 1/2002 Nagakubo et al.
2002/0030672 A1 * 3/2002 Honda et al. ..... 345/204
2002/0033830 A1 3/2002 Yamakawa
2002/0036716 A1 3/2002 Ito et al.

FOREIGN PATENT DOCUMENTS

EP 0 966 165 A1 12/1999
EP 1 085 495 A2 3/2001
EP 1 251 479 A1 10/2002
JP 2000-13814 A 1/2000

OTHER PUBLICATIONS

Patent Abstracts of Japan 2000-013814 A (Pioneer Electron Corp), Jan. 14, 2000.

* cited by examiner

*Primary Examiner*—Alexander Eisen
*Assistant Examiner*—Kenneth B Lee, Jr.
(74) *Attorney, Agent, or Firm*—Sughrue Mion, PLLC

(57) ABSTRACT

The number of subfields that are to be allocated to a luminance level in an input picture signal is changed in accordance with the peak luminance level in one field's worth of the input picture signal if the luminance level is lower than a predetermined luminance.

7 Claims, 4 Drawing Sheets

FIG. 3

| GRAYSCALE | CONVERSION TABLE | | | | | | | | | | | LIGHT EMISSION DRIVING PATTERN | | | | | | | | | |
|---|---|---|---|---|---|---|---|---|---|---|---|---|---|---|---|---|---|---|---|---|---|
| | DS | GD | | | | | | | | | | SF | SF | SF | SF | SF | SF | SF | SF | SF | SF |
| | | 1 | 2 | 3 | 4 | 5 | 6 | 7 | 8 | 9 | 10 | 1 | 2 | 3 | 4 | 5 | 6 | 7 | 8 | 9 | 10 |
| 1 | 0000 | 1 | * | * | * | * | * | * | * | * | * | ○ | | | | | | | | | |
| 2 | 0001 | 0 | 1 | * | * | * | * | * | * | * | * | ○ | ○ | | | | | | | | |
| 3 | 0010 | 0 | 0 | 1 | * | * | * | * | * | * | * | ○ | ○ | ○ | | | | | | | |
| 4 | 0011 | 0 | 0 | 0 | 1 | * | * | * | * | * | * | ○ | ○ | ○ | ○ | | | | | | |
| 5 | 0100 | 0 | 0 | 0 | 0 | 1 | * | * | * | * | * | ○ | ○ | ○ | ○ | ○ | | | | | |
| 6 | 0101 | 0 | 0 | 0 | 0 | 0 | 1 | * | * | * | * | ○ | ○ | ○ | ○ | ○ | ○ | | | | |
| 7 | 0110 | 0 | 0 | 0 | 0 | 0 | 0 | 1 | * | * | * | ○ | ○ | ○ | ○ | ○ | ○ | ○ | | | |
| 8 | 0111 | 0 | 0 | 0 | 0 | 0 | 0 | 0 | 1 | * | * | ○ | ○ | ○ | ○ | ○ | ○ | ○ | ○ | | |
| 9 | 1000 | 0 | 0 | 0 | 0 | 0 | 0 | 0 | 0 | 1 | * | ○ | ○ | ○ | ○ | ○ | ○ | ○ | ○ | ○ | |
| 10 | 1001 | 0 | 0 | 0 | 0 | 0 | 0 | 0 | 0 | 0 | 1 | ○ | ○ | ○ | ○ | ○ | ○ | ○ | ○ | ○ | ○ |
| 11 | 1010 | 0 | 0 | 0 | 0 | 0 | 0 | 0 | 0 | 0 | 0 | ○ | ○ | ○ | ○ | ○ | ○ | ○ | ○ | ○ | ○ |

* : 0 OR 1

○ : EXTINCTION MODE

○ : EMISSION MODE

DISPLAY-PANEL DRIVING METHOD

BACKGROUND OF THE INVENTION

1. Field of the Invention

The present invention relates to a display-panel driving method for displaying an image in a desired manner.

2. Description of the Related Art

In recent years, as planar thin-type display panels of the matrix display system, plasma display panels (called 'PDP' hereinbelow) and electroluminescent display panels (called 'ELDP' hereinbelow) have been put to practical use. The light-emitting elements in the PDP and ELDP only have two states, namely a light-emitting state and a non-light-emitting state and, therefore, grayscale driving that employs the subfield method is implemented in order to obtain the intermediate grayscale faithful to an input picture signal.

In the subfield method, an input picture signal is converted to pixel data of N bits for each pixel and the display period of a single field is divided up into N subfields in correspondence with N bit digits of the N-bit pixel data. The numbers of light emissions for each bit digit of the pixel data are each allocated to each subfield. If one bit digit among the N bits is logic level 1, for example, light emission is executed the allocated number of times in the subfield corresponding to the bit digit concerned. On the other hand, when the bit digit is logic level 0, light emission is not implemented in the subfield corresponding with the bit digit. According to this driving method, the luminance of the intermediate grayscale corresponding with the total number of light emissions that are implemented in the respective subfields is visualized.

However, according to the grayscale driving based on this subfield method, the drop in contrast is striking when a particularly dark image is displayed. As a result, the whole of the screen becomes darker than desired.

In order to resolve this problem, a picture signal processing circuit that adjusts the signal level of the input picture signal in accordance with the peak level of the input picture signal has been proposed in Japanese Patent Kokai (Laid Open Application) No. 2000-13814. With this picture signal processing circuit, a brighter image is displayed by increasing the input picture signal level when the peak level of the input picture signal is low.

According to this picture signal processing, although the luminance can be increased, the number of luminance grayscales for low luminance portions in the image drops to the extent of this increase, and the image quality deteriorates.

SUMMARY OF THE INVENTION

An object of the present invention is to provide a display-panel driving method that can increase the luminance without a drop in image quality for the low luminance portions of the image.

According to one aspect of the present invention, there is provided an improved display-panel driving method that drives a display panel. The display panel has a plurality of pixel cells. Each of a plurality of subfields is assigned a number of times for causing each of the pixel cells to emit light. The number of times of light emission is a period of light emission. The display-panel driving method includes the step of causing the pixel cells to execute light emission in each of a number of subfields corresponding with the luminance level indicated by an input picture signal in each field. The display-panel driving method also includes the step of controlling the number of light emissions (or the light emission period) in which the pixel cells are caused to emit light in each field by changing the number of the subfields that are to be allocated to a luminance level that is lower than a predetermined luminance in the input picture signal, in accordance with the peak luminance level of one field's worth of the input picture signal.

BRIEF DESCRIPTION OF THE DRAWINGS

FIG. 3 shows a data conversion table that is used by the pixel driving data generation circuit, together with a light-emission driving pattern in one subfield.

DETAILED DESCRIPTION OF THE INVENTION

Embodiments of the present invention will be described hereinbelow with reference to the drawings.

Figure 1:
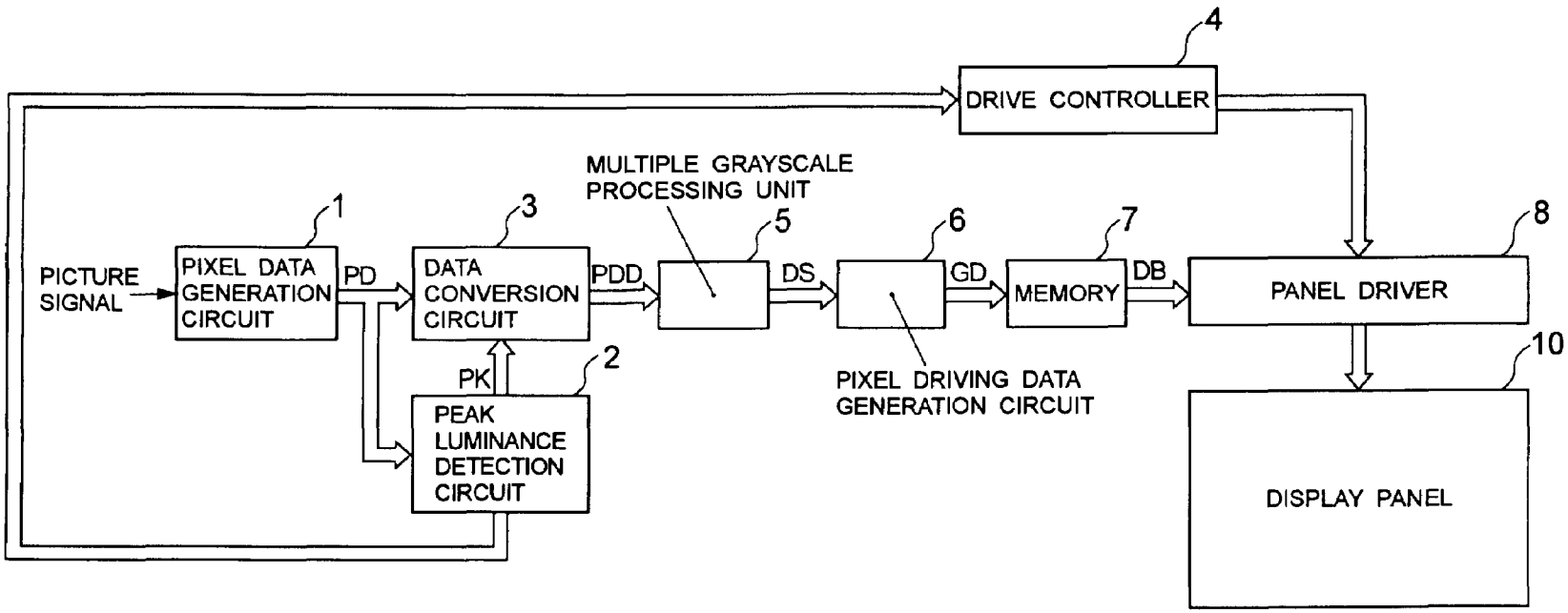
FIG. 1 shows the overall constitution of a display device that displays an image on the basis of the driving method of the present invention.

Referring to FIG. 1, the overall constitution of a display device that provides an image display on the basis of the driving method of the present invention will be described.

In FIG. 1, the display panel 10 is a plasma display panel, for example, in which pixel cells of pixels are arranged in the form of a matrix.

A pixel data generation circuit 1 converts an input picture signal to 8-bit pixel data PD, for example, that corresponds with each pixel of the display panel 10 and supplies the 8-bit pixel data PD to a peak luminance detection circuit 2 and a data conversion circuit 3.

The peak luminance detection circuit 2 detects the maximum luminance level in one screen's worth of pixel data PD and supplies a peak luminance signal PK indicating the maximum luminance level to the data conversion circuit 3 and a drive control circuit 4.

Figure 2A:
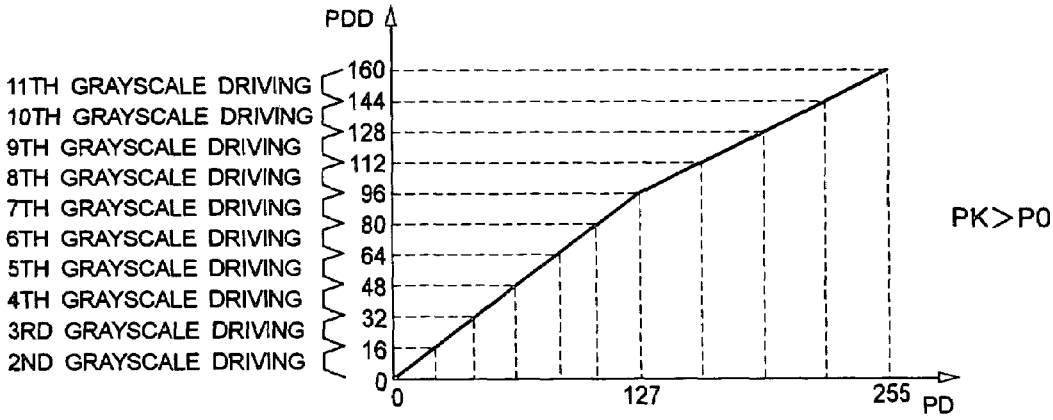
FIG. 2A shows a data conversion characteristic that is used in a data conversion circuit shown in FIG. 1.
Figure 2B:
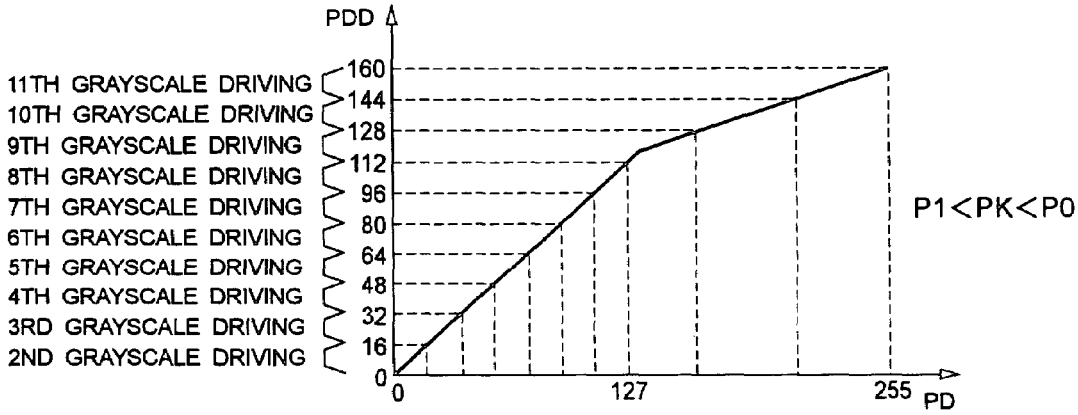
FIG. 2B shows another data conversion characteristic used under a different condition.
Figure 2C:
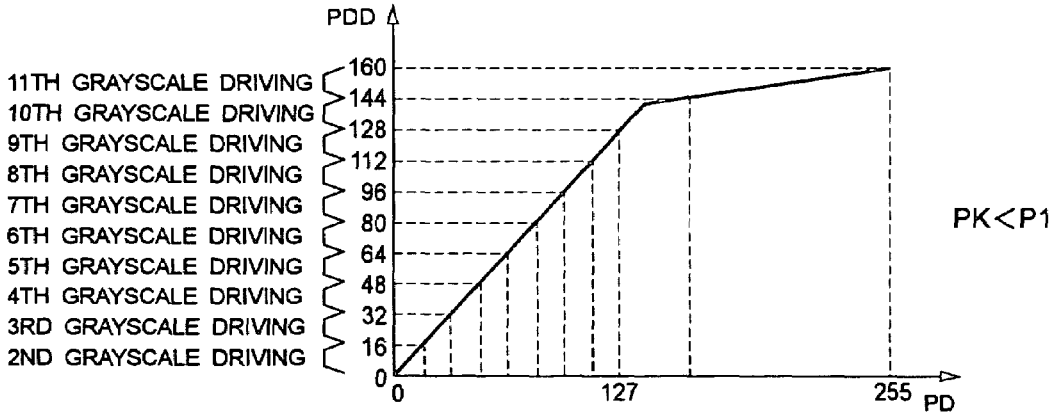
FIG. 2C shows still another data conversion characteristic used under a different condition.

The data conversion circuit 3 converts the 8-bit pixel data PD that is able to express luminance in the levels from 0 to 255 to 8-bit pixel data PDD that is able to express the luminance levels 0 to 160 by means of the conversion table shown in FIG. 2A, 2B, or 2C, and then supplies the 8-bit pixel data PDD to a multiple grayscale processing circuit 5. The data conversion circuit 3 performs data conversion by means of the conversion characteristic shown in FIG. 2A when the peak luminance signal PK indicates a luminance level that is larger than a predetermined first peak threshold value P0. The data conversion circuit 3 performs data conversion by means of the conversion characteristic shown in FIG. 2B in cases where the peak luminance signal PK indicates a luminance level that is smaller than the first peak threshold value P0 and that is larger than a second peak threshold value P1. The data conversion circuit 3 performs data conversion by means of the conversion characteristic shown in FIG. 2C in cases where the peak luminance signal PK indicates a luminance level that is smaller than the second peak threshold value P1. The conversion characteristic shown in FIG. 2C has a higher rate of luminance increase with the middle luminance portions in comparison with the conversion characteristic shown in FIG. 2B. The conversion characteristic shown in FIG. 2B has a higher rate of luminance increase with the middle luminance portions in comparison with the conversion characteristic shown in FIG. 2A. Thus, the data conversion circuit 3 performs the conversion on the pixel data PD such that the luminance is increased as the peak luminance of one screen's worth of image is low.

The multiple grayscale processing circuit 5 performs error diffusion processing and dither processing on the pixel data PDD and generates multiple grayscale pixel data DS by keeping the number of grayscales expressed for the observed image at substantially 256 grayscales while compressing the number of bits thereof to four bits. The error diffusion processing separates the upper six bits in the 8-bit pixel data PDD as display data and takes the remaining lower two bits as error data. The weighted addition of each of the error data of the pixel data PDD that correspond with each of the peripheral pixels is reflected in the display data. As a result of this operation, the lower two bits' worth of luminance of the original pixels is expressed in pseudo terms by the peripheral pixels, so that luminance grayscale expression that is the same as the 8-bit pixel data is provided by means of display data having a smaller number of bits than eight bits, that is, by means of six-bit display data. The dither processing is performed on the 6-bit pixel data obtained by this error diffusion processing. For example, in the dither processing, four pixels that are vertically and laterally adjacent to one another constitute one set and four dither coefficients consisting of mutually different coefficient values are respectively allocated and added to the four pixel data of the four pixels in the one set. As a result of this dither processing, multiple grayscale pixel data DS is generated, in which substantially the same luminance grayscale levels as the error-diffused pixel data are retained while the number of bits thereof is reduced to four bits (eleven patterns '[0000] to [1010]') as shown in FIG. 3. The multiple grayscale processing circuit 5 supplies the multiple grayscale pixel data DS to the pixel driving data generation circuit 6.

The pixel driving data generation circuit 6 converts this multiple grayscale pixel data DS to pixel driving data GD of ten bits (first to tenth bits) that effect driving of each pixel in accordance with a conversion table as shown in FIG. 3 and then supplies the pixel driving data GD to a memory 7. The sign "*" in FIG. 3 indicates that the logical level may be either 1 or 0.

The memory 7 sequentially writes the pixel driving data GD therein. When one screen's worth of writing is complete, the memory 7 reads the pixel driving data bits DB1 to DB10, which are rendered by separating the one screen's worth of pixel driving data GD into the respective bit digits as shown below.

DB1: first bit of the pixel driving data GD
DB2: second bit of the pixel driving data GD
DB3: third bit of the pixel driving data GD
DB4: fourth bit of the pixel driving data GD
DB5: fifth bit of the pixel driving data GD
DB6: sixth bit of the pixel driving data GD
DB7: seventh bit of the pixel driving data GD
DB8: eighth bit of the pixel driving data GD
DB9: ninth bit of the pixel driving data GD
DB10: tenth bit of the pixel driving data GD The memory 7 reads the pixel driving data bits DB1 to DB10 in the corresponding subfields SF1 to SF10 (shown in FIG. 4) respectively, and then supplies the pixel driving data bits DB1 to DB10 to a panel driver 8.

Figure 4:
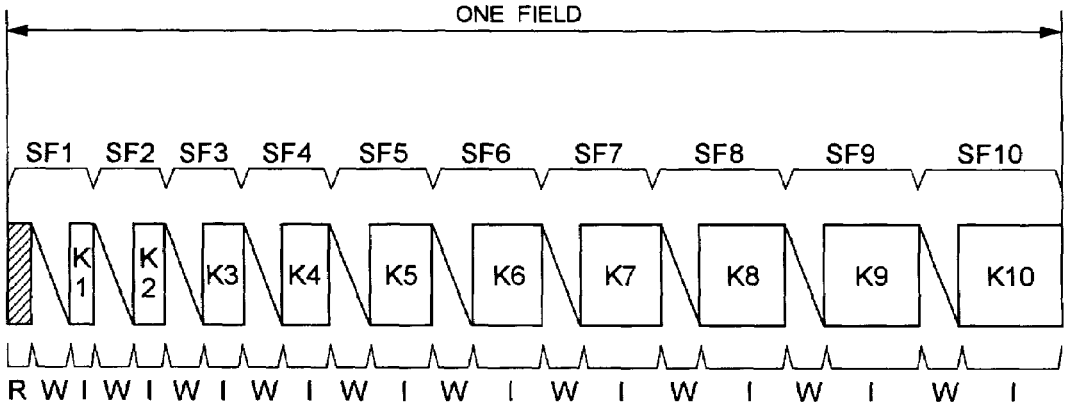
FIG. 4 shows an example of a light emission drive sequence based on the subfield method.

The drive control circuit 4 supplies various control signals to the panel driver 8. The control signals cause the display panel 10 to perform driving in accordance with the light-emitting driving sequence for which the subfield method (subframe method) is adopted as shown in FIG. 4. The panel driver 8 generates various driving pulses for driving the display panel 10 in accordance with the light-emitting driving sequence shown in FIG. 4 and supplies the driving pulses to the display panel 10.

In the light emission drive sequence shown in FIG. 4, an address step W and a sustain step I are executed for each of the subfields SF1 to SF10 in the display period of one field (one frame). In the leading subfield SF1 alone, a reset step R is executed prior to the address step W.

In the reset step R, the panel driver 8 applies, to all the pixel cells of the display panel 10, a reset pulse to initialize the pixel cells in a light emission mode state that enables all the pixel cells to emit light in the sustain step I. A state where light emission is not possible in the sustain step I is called an 'extinction mode state'.

In the address step W of each of the subfields SF1 to SF10, the panel driver 8 applies a pixel data pulse to each pixel cell. The pixel data pulse has a pulse voltage which is determined by the logic level of the pixel driving data bit DB of the subfield concerned. When the pixel driving data bit DB is logic level 1, a high-voltage pixel data pulse is applied to a pixel cell associated with the pixel driving data bit concerned, and the pixel cell shifts from the light emission mode to the extinction mode. On the other hand, when the pixel driving data bit DB is logic level 0, a low-voltage pixel data pulse is applied to the pixel cell associated with the pixel driving data bit concerned, and the pixel cell retains its current state (emission mode or extinction mode).

In the sustain step I of each subfield SFi (SF1 to SF10), the panel driver 8 applies, to all the pixel cells, a sustain pulse for causing repeated light emission of only those pixel cells which are set in the light emission mode state a number of times (or during a period) K that has been allocated to the subfield concerned.

In this driving scheme, the only opportunity for shifting the pixel cells from the extinction mode state to the light emission mode state is the reset step R of the leading subfield SF1 among the ten subfields SF1 to SF10. According to the eleven different pixel driving data GD as shown in FIG. 3, pixel cells that have been initialized in the light emission mode in the reset step R of the subfield SF1 retain the light emission mode until set in the extinction mode in the address step W of one subfield (indicated by a black circle sign) in the subfields SF1 to SF10. Therefore, in the sustain step I of each of those subfields (indicated by white circles) which exist in this interval, the pixel cells emit light a number of times (or during a period) that has been allocated to the subfield concerned. As a result, the intermediate luminance corresponding with the total number of times of light emission that is implemented in the sustain steps I over one field (subfields SF1 to SF10) is visualized. Specifically, first to eleventh grayscale driving that is able to express mutually different intermediate luminance in eleven levels in accordance with eleven different pixel driving data GD as shown in FIG. 3 is effected.

The eleven different pixel driving data GD correspond with multiple grayscale pixel data DS as shown in FIG. 3. This multiple grayscale pixel data DS is obtained by performing multiple grayscale processing on the pixel data PDD that is generated by the data conversion circuit 3. It should be assumed here that when the luminance level indicated by the pixel data PDD is "0", the multiple grayscale pixel data DS "0000" is generated. The following 4-bit multiple grayscale pixel data DS are generated depending upon the luminance levels of the pixel data PDD in this embodiment.

| luminance level | 4-bit multiple pixel data DS |
|---|---|
| "0" | "0000" |
| "1" to "16" | "0001" |
| "17" to "32" | "0010" |
| "33" to "48" | "0011" |
| "49" to "64" | "0100" |
| "65" to "80" | "0101" |
| "81" to "96" | "0110" |
| "97" to "112" | "0111" |
| "113" to "128" | "1000" |
| "129" to "144" | "1001" |
| "145" to "160" | "1010". |

Accordingly, when the luminance level indicated by the pixel data PDD is "0", the first grayscale driving shown in FIG. 3 is implemented, so that the pixel cells do not emit light at all through the subfields SF1 to SF10, i.e., a so-called black display is effected. When the luminance level indicated by the pixel data PDD is within the range "1" to "16", the second grayscale driving shown in FIG. 3 is implemented and light emission of pixel cells is effected only in the subfield SF1 of the subfields SF1 to SF10. When the luminance level indicated by the pixel data PDD is within the range "17" to "32", third grayscale driving shown in FIG. 3 is implemented and light emission of the pixel cells is effected only in the subfields SF1 and SF2 in the subfields SF1 to SF10. Similarly, pixel-cell light emission is effected continuously in each of the following subfields given the following luminance levels indicated by the pixel data PDD:

| luminance level | subfields |
|---|---|
| "33" to "48" | SF1 to SF3 |
| "49" to "64" | SF1 to SF4 |
| "65" to "80" | SF1 to SF5 |
| "81" to "96" | SF1 to SF6 |
| "97" to "112" | SF1 to SF7 |
| "113" to "128" | SF1 to SF8 |
| "129" to "144" | SF1 to SF9 |
| "145" to "160" | SF1 to SF10. |

The pixel data PDD is obtained by subjecting the pixel data PD derived from the input picture signal to data conversion based on the conversion table of FIG. 2A, FIG. 2B, or FIG. 2C.

Specifically, when the peak luminance in one screen's worth of input image (input picture signal) is relatively high (peak luminance signal PK>first peak threshold value P0), the pixel data PD is converted to pixel data PDD based on the conversion characteristic shown in FIG. 2A. According to the conversion characteristic of FIG. 2A, seven-grayscale driving (first to seventh grayscale driving) is performed on pixel data PD (input picture signal) that expresses a low luminance at or below the luminance level "127", for example.

When the peak luminance in one screen's worth of input image is medium (second peak threshold value P1<peak luminance signal PK<first peak threshold value P0), pixel data PD is converted to pixel data PDD on the basis of the conversion characteristic shown in FIG. 2B. According to the conversion characteristic of FIG. 2B, eight-grayscale driving (first to eighth grayscale driving) is performed on pixel data PD (input picture signal) that expresses a low luminance at or below the luminance level "127", for example.

When the peak luminance in one screen's worth of image is relatively low (second peak threshold value P1>peak luminance signal PK), the pixel data PD is converted to pixel data PDD on the basis of the conversion characteristic shown in FIG. 2C. According to the conversion characteristic shown in FIG. 2C, nine-grayscale driving by means of first to ninth grayscale driving is performed on pixel data PD (input picture signal) that expresses a low luminance at or below the luminance level "127", for example.

In short, with the data conversion shown in FIG. 2A to FIG. 2C, the number of subfields used for the display of the low luminance component in the input picture signal is increased as the peak luminance in one screen's worth of the image drops. Thus, the number of grayscales for the low luminance component is increased when the peak luminance is low. The number of subfields in one field and the total number (period) of light emissions in one field performed by the respective grayscale driving are constant irrespective of the peak luminance.

As a result of the above described driving, the luminance can be raised without deterioration of image quality in low luminance portions.

This application is based on a Japanese Patent Application No. 2004-111848 filed on Apr. 6, 2004 and the entire disclosure thereof is incorporated herein by reference.

What is claimed is:

1. A method for driving a display panel on which a plurality of pixel cells are formed, in each of a plurality of subfields to which a number of times or a period for causing each of the pixel cells to emit light is allocated, said plurality of subfields defining a single field of an input picture signal, said method comprising the steps of:

causing the pixel cells to emit light in each of a number of subfields corresponding with a luminance level indicated by the input picture signal in each field; and controlling the number of light emissions or the light emission period in which the pixel cells are caused to emit light in each field by changing the number of the subfields that are to be allocated to a luminance level lower than a predetermined luminance in the input picture signal, in accordance with a peak luminance level of each field of the input picture signal, wherein a total number of the subfields constituting each field and a maximum number of light emissions in one field are constant irrespective of the peak luminance level.

2. The method according to claim 1, wherein, when the peak luminance level is low, the number of the subfields that are to be allocated to the luminance level lower than the predetermined luminance is increased in comparison with a case where the peak luminance level is high.

3. A method for driving a display panel on which a plurality of pixel cells are formed, in each of a plurality of subfields to which a number of times or a period for causing each of the pixel cells to emit light is allocated, said plurality of subfields defining a single field of an input picture signal, said method comprising the steps of:

causing the pixel cells to emit light in each of a number of subfields corresponding with a luminance level indicated by the input picture signal in each field; and controlling the number of light emissions or the light emission period in which the pixel cells are caused to emit light in each field by changing the number of the subfields that are to be allocated to a luminance level lower than a predetermined luminance in the input picture signal, in accordance with a peak luminance level of each field of the input picture signal wherein, when the peak luminance level is low, the number of the subfields that are to be allocated to the luminance level lower than the predetermined luminance is increased in comparison with a case where the peak luminance level is high, wherein a total number of the subfields constituting each field and a maximum number of light emissions in one field are constant irrespective of the peak luminance level.

4. An apparatus for driving a display panel on which a plurality of pixel cells are formed, in each of a plurality of subfields to which a number of times or a period for causing each of the pixel cells to emit light is allocated, said plurality of subfields defining a single field of an input picture signal, said apparatus comprising:

means for causing the pixel cells to emit light in each of a number of subfields corresponding with a luminance level indicated by the input picture signal in each field; and means for controlling the number of light emissions or the light emission period in which the pixel cells are caused to emit light in each field by changing the number of the subfields that are to be allocated to a luminance level lower than a predetermined luminance in the input picture signal, in accordance with a peak luminance level of each field of the input picture signal, wherein a total number of the subfields constituting each field and a maximum number of light emissions in one field are constant irrespective of the peak luminance level.

5. The apparatus according to claim 4, wherein, when the peak luminance level is low, the number of the subfields that are to be allocated to the luminance level lower than the predetermined luminance is increased in comparison with a case where the peak luminance level is high.

6. An apparatus for driving a display panel on which a plurality of pixel cells are formed, in each of a plurality of subfields to which a number of times or a period for causing each of the pixel cells to emit light is allocated, said plurality of subfields defining a single field of an input picture signal, said apparatus comprising:

means for causing the pixel cells to emit light in each of a number of subfields corresponding with a luminance level indicated by the input picture signal in each field; and means for controlling the number of light emissions or the light emission period in which the pixel cells are caused to emit light in each field by changing the number of the subfields that are to be allocated to a luminance level lower than a predetermined luminance in the input picture signal, in accordance with a peak luminance level of each field of the input picture signal wherein, when the peak luminance level is low, the number of the subfields that are to be allocated to the luminance level lower than the predetermined luminance is increased in comparison with a case where the peak luminance level is high, wherein a total number of the subfields constituting each field and a maximum number of light emissions in one field are constant irrespective of the peak luminance level.

7. The method for driving a display panel according to claim 1, wherein the total number of the subfields constituting each field remains constant irrespective of the changing the number of the subfields that are to be allocated to a luminance level lower than a predetermined luminance in the input picture signal.

* * * * *